United States Patent [19]

Waxman

[11] Patent Number: 4,526,292

[45] Date of Patent: Jul. 2, 1985

[54] CHEST FOR STORING, HEATING AND DISPENSING ARTICLES

[75] Inventor: Jay Waxman, Skokie, Ill.

[73] Assignee: JayVol Inc., Ill.

[21] Appl. No.: 516,994

[22] Filed: Jul. 25, 1983

[51] Int. Cl.[3] ..... G07F 11/00; A47F 1/00

[52] U.S. Cl. ..... 221/97; 221/150 A; 221/131; 221/195; 221/271; 604/403

[58] Field of Search ..... 221/92, 97, 123, 124, 221/131, 150 A, 191, 194, 195, 196, 263, 264, 271, 272, 281, 287, 197; 132/36 R; 604/403; 219/242, 385, 386, 521; 312/45, 72, 236

[56] References Cited

U.S. PATENT DOCUMENTS

| | | | |
|---|---|---|---|
| 1,766,097 | 6/1930 | Bonaventura | 221/131 |
| 3,754,116 | 8/1973 | Godel | 219/521 |
| 4,015,885 | 4/1977 | Baggaley | 312/45 |

*Primary Examiner*—Joseph J. Rolla
*Assistant Examiner*—Louise Heim
*Attorney, Agent, or Firm*—Robert E. Knechtel

[57] ABSTRACT

A chest for storing, warming and dispensing ampules of medicants such as novocaine. In addition, provision is made for storing the hypodermic needles and the hypodermic syringes separately from the ampules of medicants so that the hypodermic syringes, the hypodermic needles and the ampules of medicants all are stored in orderly fashion. In particular, the chest includes a number of apertures for receiving therein the hypodermic syringes so that the hypodermic syringe can be easily selected for use. The chest includes two covered compartments which have trays removably stored therein. The hypodermic needles can be stored in one of the two trays and ampules of medicants such as novocaine or the like can be stored in the other one of the two trays. In addition, each of the two compartments is formed to receive a number of the ampules and to convey these ampules to a dispensing mechanism which is actuated simply by pressing a handle at the front of the chest to individually dispense the ampules. A heating element is disposed within the chest for heating and maintaining the temperature of the ampules the hypodermic needles and the hypodermic syringes at approximately 90° F.

10 Claims, 4 Drawing Figures

CHEST FOR STORING, HEATING AND DISPENSING ARTICLES

BACKGROUND AND SUMMARY OF INVENTION

This invention relates to an improved chest for storing, heating and dispensing articles. More particularly, it relates to an improved chest for storing, heating and dispensing ampules of novocaine or other like medicants, and for storing and heating the hypodermic syringes and hypodermic needles used in injecting such medicants.

It is generally well-known that individuals receiving injections of certain medicants, such as novocaine, experience some pain and that this pain is due, to some degree, to the temperature of the medicant being injected. In particular, if the medicant is below a certain temperature, the pain experienced is usually greater. In the case of novocaine, for example, it is recommended that its temperature be in the range of 85° F. to 95° F. when injected. Also, it is preferred that the hypodermic syringe and the hypodermic needle be likewise heated prior to injection of a medicant such as novocaine.

In the past, it has generally been the practice to simply store the hypodermic syringes, the hypodermic needles and the ampules of novocaine in a warming tray. These warming trays are not entirely satisfactory in that there is no convenient arrangement of the individual components and they are simply stored in bulk. Accordingly, when it is desired to extract an ampule of novocaine from the warming tray, it is necessary to sort through the various articles to accumulate an ampule of novocaine, a hypodermic needle and a hypodermic syringe for the injection.

In accordance with the present invention, a chest is provided for storing, warming and dispensing the ampules of medicants such as novocaine. In addition, provision is made for storing the hypodermic needles and the hypodermic syringes separately from the ampules of medicants so that the hypodermic syringes, the hypodermic needles and the ampules of medicants all are stored in orderly fashion. In particular, the chest includes a number of apertures for receiving therein the hypodermic syringes so that the hypodermic syringe can be easily selected for use. The chest includes two covered compartments which have trays removably stored therein. The hypodermic needles can be stored in the two trays, with each tray storing a different size needle. In addition, each of the two compartments is formed to receive a number of the ampules and to convey these ampules to a dispensing mechanism which is actuated simply by pressing a handle at the front of the chest to individually dispense the ampules. Two different types of medicants can be accommodated, with one type being stored in each of the respective ones of the compartments. A heating element is disposed within the chest for heating the ampules, the hypodermic needles and the hypodermic syringes, together with a temperature sensor for maintaining the temperature of them at approximately 90° F. The U.S. Pharmocopea classifies 104° F. as excessive for this class of medicants, and the temperature sensor therefore maintains the temperature well within an acceptable range.

Accordingly, it is an object of the present invention to provide an improved chest for storing, heating and dispensing articles, particularly ampules of medicants; such as novocaine or the like. More particularly still, in addition to dispensing individual ampules of medicants, the chest also is adapted to store and to heat the hypodermic syringes and hypodermic needles used to inject the medicants. An important feature of the chest is that the ampules, which are coded for use, are stored and dispensed in a first in, first out manner.

DESCRIPTION OF THE DRAWINGS

The above object as well as other objects not specifically mentioned will become apparent from the following description taken in conjunction with the drawings, in which.

DESCRIPTION OF THE INVENTION

Figure 1:
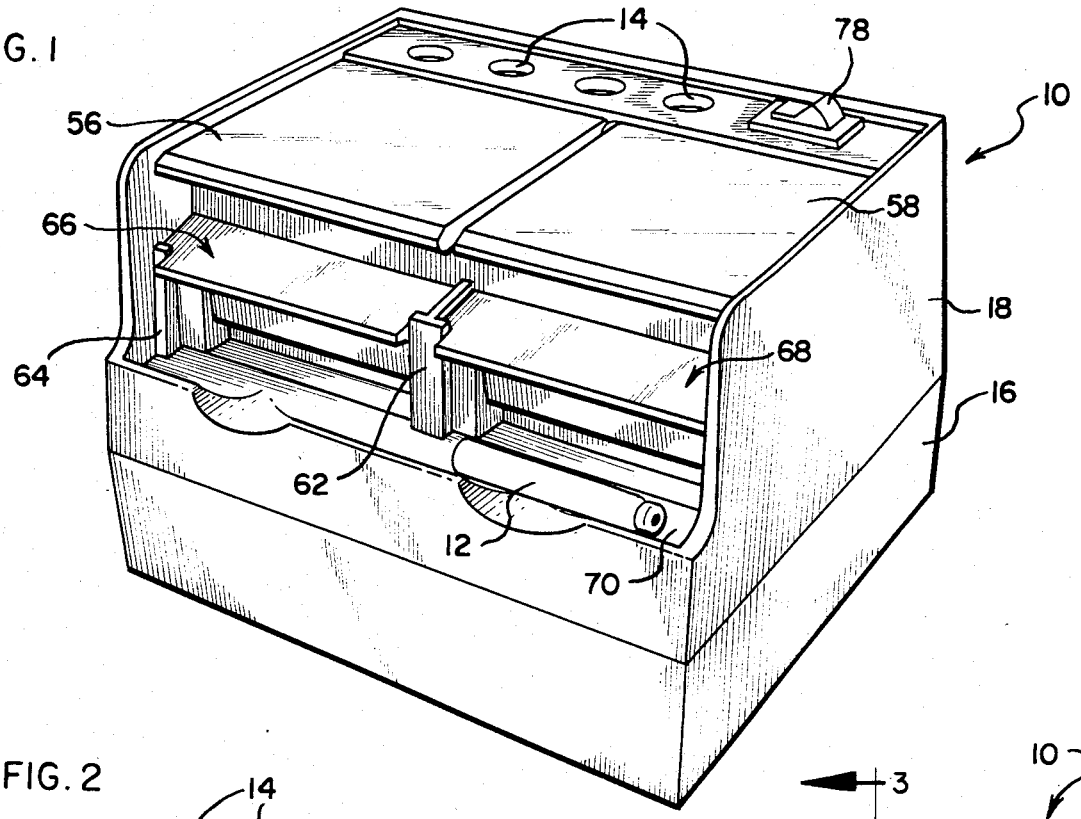
FIG. 1 is a perspective view of a chest exemplary of the present invention.

Referring now to the drawing, in FIG. 1 there is illustrated a chest 10 exemplary of the invention for storing, heating and dispensing ampules 12 which may contain, for example, novocaine. In addition, the chest 10 includes a number of openings 14, four as illustrated, for receiving and storing therein hypodermic syringes (not shown). The chest 10 includes a wall 42 dividing it into two compartments 38 and 40 which are covered by covers 56 and 58, respectively. Each of these compartments 38 and 40 include a removable tray, such as the removable tray 52 illustrated in FIG. 3, for storing in each of the respective trays a supply of different size hypodermic needles, as more fully described below. The ampules 12 are individually dispensed from the chest 10 on a first in, first out manner simply by actuating one or the other of the dispensing mechanisms 66 and 68, the operation of which will result in the deposit of an individual ampule 12 on the front wall or shelf 70 of the chest 10. As indicated above, the chest 10 includes a heating element for maintaining the hypodermic syringes, the hypodermic needles and the ampules 12 at a temperature of approximately 90 degrees.

Figure 2:
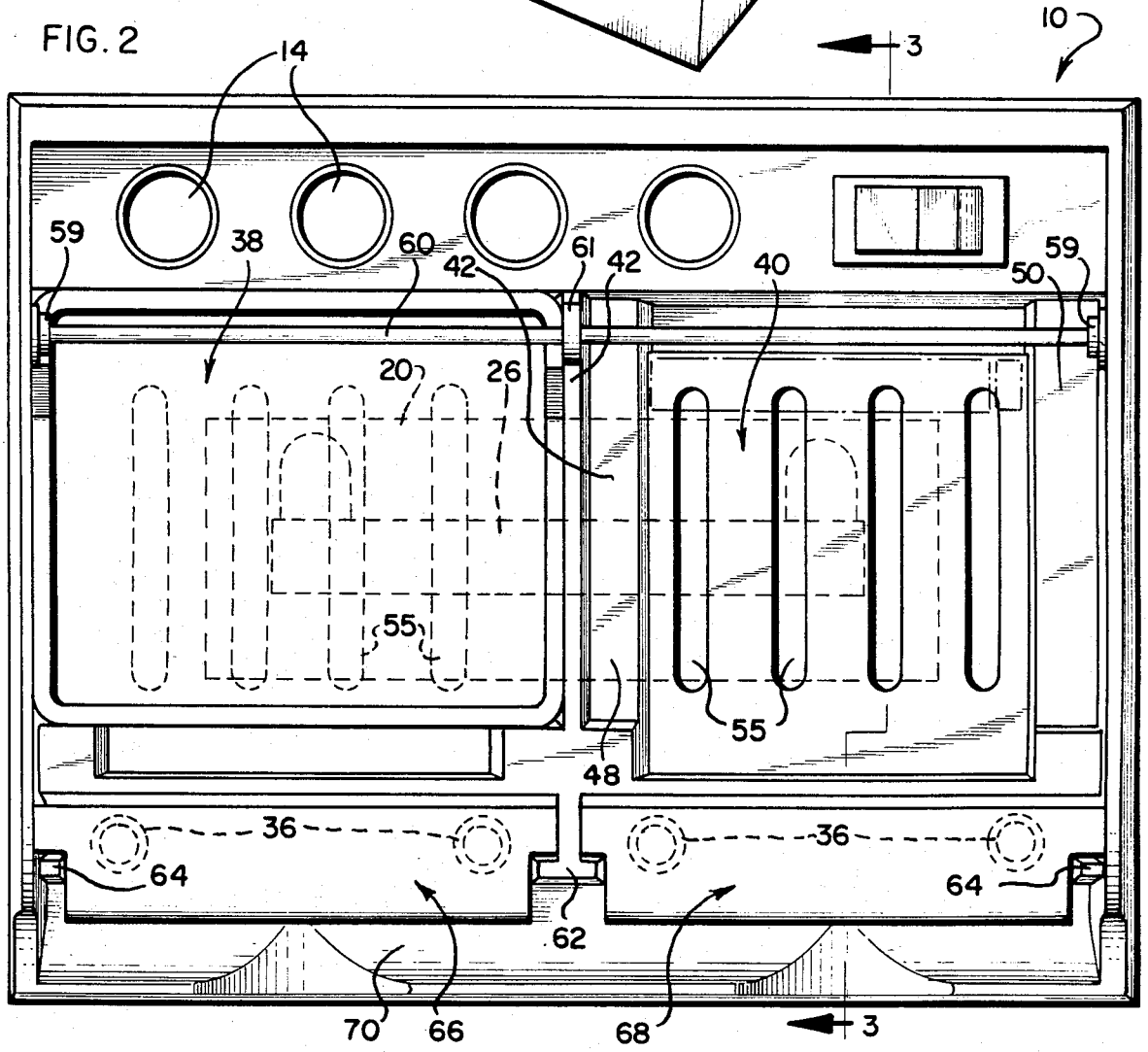
FIG. 2 is a top perspective view of the chest of FIG. 1 with certain elements thereof removed for clarity in explaining the invention.
Figure 3:
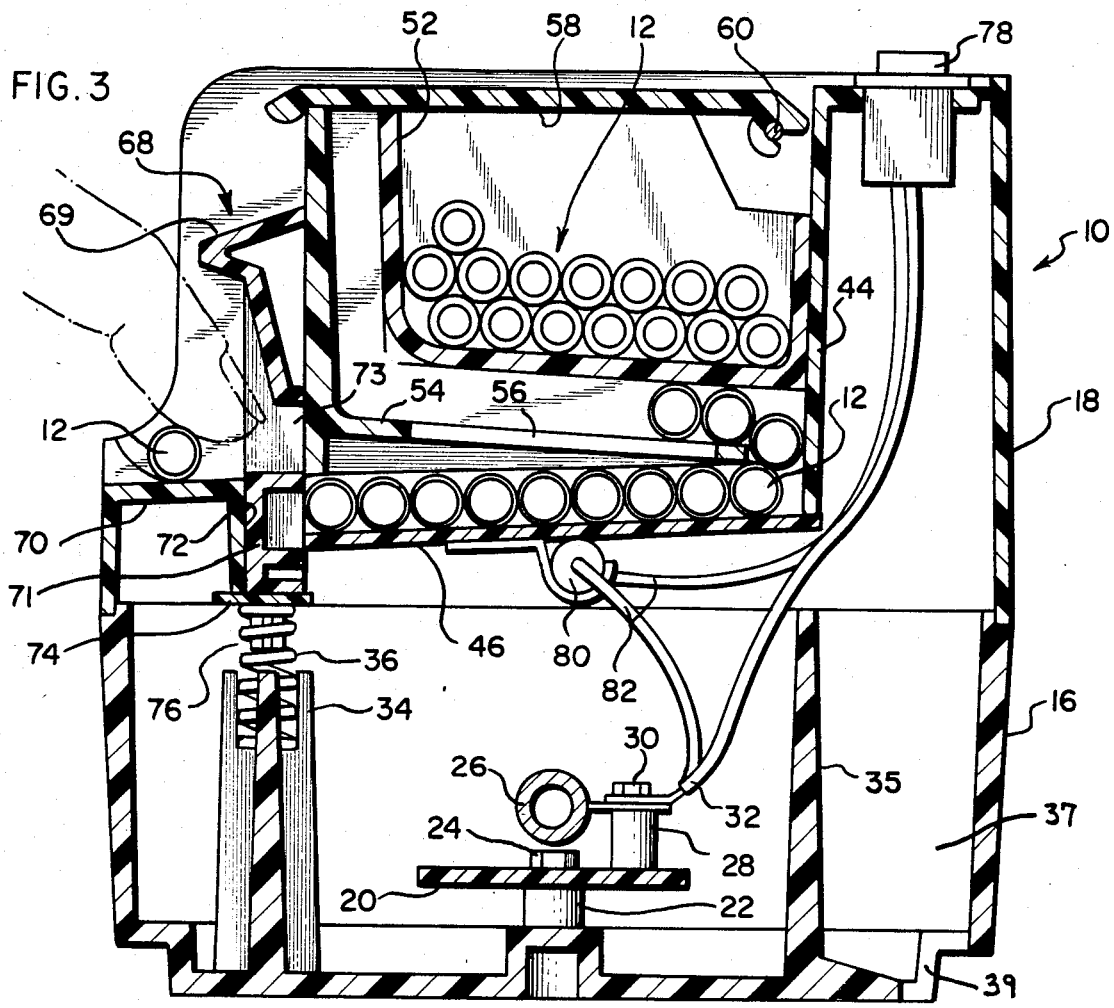
FIG. 3 is a sectional view taken along lines 3—3 of FIG. 2.

More particularly, the chest 10 preferably and advantageously is molded of plastic and includes a base portion 16 and a top portion 18 which are affixed together by sonicly welding or otherwise affixing them together to form a generally hollow enclosure, as can be best seen in FIG. 3. A phenolic board 20 is mounted to a pair of posts 22 which are disposed substantially centrally in the base portion 16. The phenolic board 20 is affixed to the posts 22 by means of threaded bolts 24 or the like. A heating element 26 which may be, for example, a large resistive element, is supported atop the phenolic board 20 by means of a pair of posts 28 which are spaced apart and affixed to the phenolic board 20. The heating element 26 and the posts 28 both are affixed to the phenolic board 20 by means of threaded bolts 30 or the like. Electrical wires 32 for energizing the heating element 26 likewise are affixed to and supported by the respective ones of the posts 28 for establishing electrical contact with the heating element 26. A temperature sensor 80 is supported below the ramp or wall 46, and by means of the electrical wires 82 is electrically included in a circuit with the heating element 26 and a switch 78. Interiorly of the base portion 16 there may be a number of supporting ribs such as the supporting ribs 34 and 35 for adding rigidity to the base portion 16. In addition, the supporting rib 34 is formed to provide spaced-apart support posts having top portions which are adapted to receive and support springs 36 which function to operate the dispensing mechanisms 66 and 68, as more fully described below. As can be best seen in FIG. 2, there are four such support posts for supporting springs 36 for actuating the dispensing mechanisms. The supporting rib 35 also provides a wall which forms a compartment 37 into which needle guards for the hypodermic needles can fall to prevent them from falling into the compartment containing the heating element 26. A slot 39 is provided in the bottom of the compartment 37 to permit the needle guards to be easily removed from the chest 10.

Within the top portion 18 of the chest 10 there are formed the two compartments 38 and 40. The two compartments 38 and 40 are separated by a wall 42 (FIG. 2). More particularly, as can be seen in FIG. 3, the compartments 38 and 40 are formed by an interior wall 44 which is substantially vertically disposed and an interior wall 46 which is substantially horizontally disposed but angles down slightly towards the front of the chest 10 to form an inclined ramp. The ampules 12, as more fully described below, roll down the inclined ramp or wall 46 to the dispensing mechanism 66 and 68 at the front of the chest 10.

In FIG. 2, the chest 10 is shown with the covers 56 and 58 removed and, in addition, the removable tray 52 has been removed from the compartment 40. Accordingly, as can be best seen in FIG. 2, a pair of ledges 48 and 50 are formed in the respective ones of the compartments 38 and 40 for supporting the removable trays 52 in spaced relationship to the bottom of the compartments. Below the removable trays 52 in the compartments 38 and 40 there is formed a second horizontally disposed inclined ramp 54 which slopes downwardly towards the rear of the chest 10, as can be best seen in FIG. 3. The second horizontally disposed inclined ramps 54 have slots 55 formed in them for permitting the passage of heated air and to permit the ampules 12 to be manually manipulated by means of a pencil or the like extended through the slots 55 to orient the ampules 12 in the event they become disoriented on the inclined ramp 46. The covers 56 and 58, as can be best seen in FIG. 3 are affixed to a rod 60 which is supported at each of its opposite ends by means of journals or bearings 59 and at its center by means of journal or beairng 61 such that the covers 56 and 58 can be pivotally opened and closed over the compartments 56 and 58.

Figure 4:
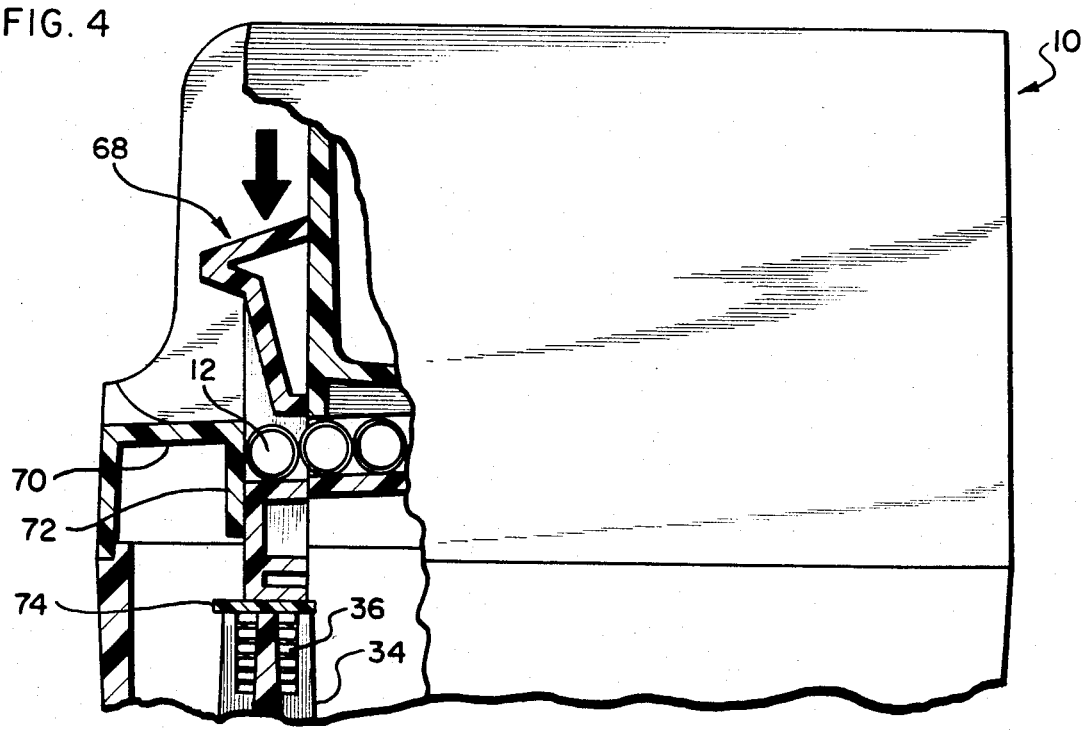
FIG. 4 is a partial sectional view illustrating the operation of the dispensing mechanism of the chest.

At the front of the chest 10 there is provided a T-shaped guide 62 which is disposed centrally of the two compartments 56 and 58 and at each of the opposite sides of the chest 10 there are two guide posts 64 which are correspondingly formed and positioned with respect to the T-shaped guide 62 to guide the dispensing mechanisms 66 and 68. As can be best seen in FIG. 3, the front shelf 70 of the chest 10 is formed with a pair of slots 72 for receiving therein the dispensing mechanisms 66 and 68, respectively. The dispensing mechanisms 66 and 68 each are integral structures including a handle portion 69, a lower base portion 71 and side walls 73. The dispensing mechanisms 66 and 68 are slidably reciprocally retained within respective ones of the slots 72 in the front shelf 70 of the chest 10, and are spring biased to a normally raised or closed position by the springs 36. In this respect, the base portions 71 have a flat plate 74 affixed to the bottom thereof to act as stops to retain the dispensing mechanisms 66 and 68. The dispensing mechanisms 66 and 68 also have two spaced apart studs 76 on them which are adapted to be received within the springs 36 supported by the supports posts 34. As can be best seen in FIG. 4, the dispensing mechanisms 66 and 68 are manually actuated simply by pressing downwardly on the handles 69. The tops of the support posts 34 form stops, when engaged by the flat plates 74. In this position, an ampule 12 will roll from the inclined ramp 46 into the open space between the handle 69 and the top of the base portion 71 and abut against the wall of the slot 72 in the front shelf 70 of the chest 10. When the pressure on the handle 69 of the dispensing mechanism 66 or 68 is released, the springs 36 forcibly urge the dispensing mechanisms to their normally raised or closed positions. With the dispensing mechanisms in their raised or closed positions, an ampule 12 extracted from the compartment 56 or 58 rolls onto the front shelf 70 where it is contained and can be easily and simply removed by the fingers of an individual.

The chest 10 is coupled to any appropriate electrical outlet to energize it and the heating element 26 of the chest 10 is energized to heat the chest 10 by actuation of the electrical switch 78.

As indicated above, the chest 10 has openings 14 in its top for receiving therein hypodermic syringes which are simply vertically disposed within the openings 14 so as to extend downwardly into the interior of the chest 10. A number of hypodermic needles for use with the hypodermic syringes can be separately stored in the respective ones of the two removable trays 52 within the compartments 56 and 58. Also, a number of ampules 12 can be stored on the inclined ramps 54 and 46 and individually dispensed by means of the dispensing mechanisms 66 and 68 as illustrated in FIG. 3 and as described above. These ampules 12 can be disposed on the inclined ramps 54 and 46 by removing the removable trays 52 and placing them on the inclined ramp 54. As the ampules 12 are disposed on the inclined ramp 54, the ampules will roll down the ramp onto the inclined ramp 46 towards the front of the chest 10 where at they are individually dispensed on a first in, first out manner, by means of the dispensing mechanism 66 and 68 as described above. Alternatively, the ampules 12 can be simply dropped into the slot formed between the tray 52 and the front wall of the chest 12 onto the ramp 54. When it is desired to dispense one of the individual ampules 12, the handle 69 of the dispensing mechanism 66 or 68 is merely pressed downwardly to load one of the ampules 12 on top of the base portion 71 of the dispensing mechanism, and then releasing the pressure on the handle 69. The ampule 12 then will be raised and permitted to roll onto the front shelf 70 of the chest 10 where at it can be extracted by the fingers of an individual. The heating element 26 heats the ampules, the hypodermic needles and the hypodermic syringes, and the temperature sensor 80 maintains the temperature within a range of 85° F. to 95° F.

Accordingly, it can be seen from the above-description that an improved chest for storing and heating ampules of medicants, such as novocaine, hypodermic syringes and hypodermic needles, and for individually dispensing the ampules of medicants is provided by the present invention. While a specific embodiment of the invention is illustrated and described, it is obvious that certain modifications can be made to the construction of the chest 10 without parting from the scope of the claims.

What is claimed is:

1. A chest for storing, heating and dispensing ampules of medical products such as novocaine, said chest being a generally hollow enclosure and having therein at least a pair of separated compartments, the bottom wall of said compartments sloping downwardly toward the front of said chest and forming an inclined ramp a cover for each of said pair of compartments which can be opened to remove or to place ampules in said compartments;

an opening in said chest in communication with each of said respective compartments;

a dispensing apparatus associated with each of said compartments for dispensing individual ones of said ampules stored in the individual ones of said compartments, the respective ones of said dispensing apparatus being disposed within one of said openings in said chest and normally biased to a closed position, said dispensing apparatus being manually depressable to a position permitting an individual one of said ampules on said inclined ramp to be extracted from said inclined ramp and to be dispensed from said chest by releasing and permitting said dispensing apparatus to return to the normally closed position;

heating apparatus within said chest for heating said ampules to a pre-established temperature; and a plurality of openings in said chest for receiving and storing therein hypodermic syringes, said heating apparatus being disposed within said chest and juxtaposed to both said ampule storage compartments and said openings for the syringes, whereby both said ampules and hypodermic syringes are heated.

2. The chest of claim 1, wherein said heating apparatus comprises a resistive element within said chest.

3. The chest of claim 1, being formed of a plastic material.

4. The chest of claim 1, wherein said dispensing apparatus are normally biased to a closed position by means of helical springs.

5. The chest of claim 1, further comprising switch means for controlling the energization of said heating apparatus.

6. The chest of claim 1, wherein said dispensing apparatus operates to dispense individual ones of said ampules in a first in, first out manner.

7. The chest of claim 1, further comprising within said hollow enclosure forming said chest a needle guard compartment for receiving therein needle guards normally affixed to said hypodermic syringes, said needle guard compartment being disposed beneath said plurality of openings for receiving and storing said hypodermic syringes, and a slot provided in said chest in communication with said needle guard compartment, whereby needle guards within said needle guard compartment can be easily removed from said chest.

8. The chest of claim 1, further comprising a removable tray within each of said compartments for storing a supply of ampules, hypodermic needles and the like, whereby said ampules and hypodermic needles are heated.

9. The chest of claim 8, further comprising within each said compartment, a second inclined ramp which slopes toward the back of said chest, said second inclined ramp being disposed between said removable trays in said compartments and the bottom walls of said compartments.

10. The chest of claim 9, wherein said second inclined ramps have slots formed in them, whereby said ampules can be properly oriented by extending an object through said slots in the event said ampules become disoriented on said bottom wall forming an inclined ramp.

* * * * *